US009429892B2

(12) United States Patent
Watanabe et al.

(10) Patent No.: US 9,429,892 B2
(45) Date of Patent: Aug. 30, 2016

(54) RECORDING MEDIUM DETERMINATION APPARATUS AND IMAGE FORMING APPARATUS

(71) Applicant: CANON KABUSHIKI KAISHA, Tokyo (JP)

(72) Inventors: Shuhei Watanabe, Yokohama (JP); Tsutomu Ishida, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 14/681,468

(22) Filed: Apr. 8, 2015

(65) Prior Publication Data

US 2015/0309459 A1 Oct. 29, 2015

(30) Foreign Application Priority Data

Apr. 25, 2014 (JP) ..... 2014-091678

(51) Int. Cl.
*G03G 15/00* (2006.01)

(52) U.S. Cl.
CPC *G03G 15/5029* (2013.01); *G03G 2215/00637* (2013.01); *G03G 2215/00742* (2013.01)

(58) Field of Classification Search
CPC ..... G03G 15/5029; G03G 2215/00637
USPC ..... 399/45
See application file for complete search history.

(56) References Cited

U.S. PATENT DOCUMENTS

| | | | | |
|---|---|---|---|---|
| 4,446,735 | A | 5/1984 | Weilacher | |
| 7,082,832 | B2 | 8/2006 | Yabuta et al. | |
| 8,774,653 | B2 | 7/2014 | Iwasa et al. | |
| 2009/0310981 | A1* | 12/2009 | Ishida | G03G 15/65 399/17 |
| 2009/0310992 | A1* | 12/2009 | Iwasa | G03G 15/5029 399/45 |
| 2013/0041602 | A1 | 2/2013 | Ishida et al. | |
| 2015/0037053 | A1 | 2/2015 | Ishida | |

FOREIGN PATENT DOCUMENTS

| | | | |
|---|---|---|---|
| JP | 57-132055 | A | 8/1982 |
| JP | 2004-210495 | A | 7/2004 |
| JP | 2004-210497 | A | 7/2004 |
| JP | 2010-18433 | A | 1/2010 |
| JP | 2011-68448 | A | 4/2011 |
| JP | 2013-40000 | A | 2/2013 |
| JP | 2013-217926 | A | 10/2013 |

* cited by examiner

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

The recording medium determination apparatus includes a transmission unit for transmitting an ultrasonic wave, a receiving unit for outputting a signal corresponding to the ultrasonic wave, a peak extraction unit for detecting a value of the signal output from the receiving unit, a control unit for determining basis weight of a recording medium based on the value of the signal, and a timer for measuring a period of time from when the transmission unit transmits the ultrasonic wave to the detection by the peak extraction unit. The control unit calculates, based on a period of time measured by the timer at the time of factory shipment and a period of time measured by the timer after the factory shipment, variation of a distance between the transmission unit and the receiving unit after the factory shipment.

21 Claims, 8 Drawing Sheets

RECORDING MEDIUM DETERMINATION APPARATUS AND IMAGE FORMING APPARATUS

BACKGROUND OF THE INVENTION

1. Field of the Invention

The present invention relates to a recording medium determination apparatus configured to determine basis weight of a recording medium, and to an image forming apparatus.

2. Description of the Related Art

An image forming apparatus such as a copying machine or a laser printer using an electrophotographic process includes an image forming portion configured to form a toner image on an image bearing member, a transfer portion configured to transfer the toner image formed on the image bearing member onto a recording medium, and a fixing portion configured to heat and pressurize the recording medium to fix the toner image onto the recording medium. Hitherto, in such an image forming apparatus, a user sets a size or a type of the recording medium, for example, by an external apparatus such as a computer or via an operation panel installed in an image forming apparatus main body. Based on the setting, the image forming apparatus controls a transfer condition (e.g., transfer voltage or conveyance velocity of recording medium during transfer) and a fixing condition (e.g., fixing temperature or conveyance velocity of recording medium during fixing). In order to reduce such a user's setting burden, there has recently been offered an image forming apparatus that includes a sensor for determining a recording medium and thus automatically determines a type of the recording medium. In such an image forming apparatus, the type of the recording medium is automatically determined, and a transfer condition and a fixing condition are set in accordance with the determination result.

For example, as proposed in Japanese Patent Application Laid-Open No. S57-132055, there is known a sensor for determining basis weight (mass per unit area) of a recording medium by irradiating the recording medium with an ultrasonic wave and receiving the attenuated ultrasonic wave via the recording medium. When such a sensor using the ultrasonic wave (hereinafter referred to as ultrasonic sensor) is used for determining basis weight, it is desired to keep circumstances surrounding the sensor (e.g., atmospheric pressure and temperature) under certain conditions. This is because amplitude of the ultrasonic wave is known to change depending on surrounding circumstances thereof and affect the determination result of the basis weight. However, the circumstances in which the image forming apparatus including the ultrasonic sensor is installed are not always constant. As a method of reducing such influences, for example, in Japanese Patent Application Laid-Open No. 2010-18433, there is proposed a method of reducing or cancelling the influence of circumstance variation based on amplitude of an ultrasonic wave in an absent condition of any recording medium.

As the method of reducing the influence of circumstance variation on the basis weight determination, as described above, there is known a method of cancelling the influence of circumstance variation by measuring an ultrasonic output in the absent condition of any recording medium to perform correction. However, factors affecting the basis weight determination carried out by using the ultrasonic sensor are not limited to the circumstance variation. For example, even when a positional relationship (distance) between a transmission unit and a receiving unit of the ultrasonic wave changes, amplitude of the received ultrasonic wave changes. When the circumstance correction is carried out under this condition, the ultrasonic output in the absent condition of any recording medium also changes, and thus correction accuracy may reduce. Therefore, it is desired to install the transmission unit and the receiving unit of the ultrasonic wave in the image forming apparatus in such a manner that the positional relationship therebetween does not change. However, because of circumstances described below, an installing position of the basis weight detection sensor using the ultrasonic wave is limited, and it is difficult to maintain constant the positional relationship between the transmission unit and the receiving unit.

When the basis weight is determined by the ultrasonic wave, the transmission unit and the receiving unit of the ultrasonic wave need to be arranged so as to sandwich the recording medium, and it is accordingly difficult to integrate the transmission unit and the receiving unit. Further, because the transfer condition and the fixing condition are determined based on the determination result of the basis weight detection sensor, the sensor needs to be arranged on an upstream of a conveyance path of the recording medium, that is, on at least before the transfer portion configured to transfer the toner image formed on the image bearing member onto the recording medium. The image forming apparatus generally has a mechanism for removing the recording medium in case that the recording medium stays on the conveyance path (jamming). Accordingly, for example, the transfer unit is an open/close type in many cases, and one of the transmission unit and the receiving unit of the ultrasonic wave is arranged on the transfer unit. However, when the sensor is installed in such an openable/closable and movable portion, a position of the sensor may shift due to the open/close operation. Thus, there is a high risk that the positional relationship (distance) between the transmission unit and the receiving unit of the ultrasonic wave cannot be maintained constant.

SUMMARY OF THE INVENTION

The present invention has been made under those circumstances, and it is an object of the present invention to improve determination accuracy of basis weight of a recording medium by preventing a reduction in correction accuracy of circumstance variation caused by position deviation of a basis weight detection sensor.

In order to solve the above-mentioned problem, the following is provided.

According to one embodiment of the present invention, there is provided a recording medium determination apparatus, including: a transmission unit configured to transmit an ultrasonic wave; a receiving unit configured to receive the ultrasonic wave transmitted from the transmission unit and passed through a recording medium and output a first signal corresponding to the received ultrasonic wave, and to receive the ultrasonic wave transmitted from the transmission unit and not passed through the recording medium and output a second signal corresponding to the received ultrasonic wave; a detection unit configured to detect a value of the first signal and a value of the second signal output from the receiving unit; a control unit configured to determine basis weight of the recording medium based on the value of the first signal detected by the detection unit; and a measurement unit configured to measure a period of time from when the transmission unit transmits the ultrasonic wave to when the detection unit detects the value of the second signal, the control unit being configured to calculate, based on a period of time measured by the measurement unit in a first condition and a period of time measured by the measurement unit in a second condition that is different from the first condition, variation of a distance between the transmission unit and the receiving unit from the first condition to the second condition, to thereby determine the basis weight of the recording medium in accordance with the calculated variation of the distance and the value of the first signal.

Further, according to one embodiment of the present invention, there is provided an image forming apparatus, including: an image forming unit configured to form an image on a recording medium; a transmission unit configured to transmit an ultrasonic wave; a receiving unit configured to receive the ultrasonic wave transmitted from the transmission unit and passed through the recording medium and output a first signal corresponding to the received ultrasonic wave, and to receive the ultrasonic wave transmitted from the transmission unit and not passed through the recording medium and output a second signal corresponding to the received ultrasonic wave; a detection unit configured to detect a value of the first signal and a value of the second signal output from the receiving unit; a control unit configured to control an image forming condition of the image forming unit based on the value of the first signal detected by the detection unit; and a measurement unit configured to measure a period of time from when the transmission unit transmits the ultrasonic wave to when the detection unit detects the value of the second signal, the control unit being configured to calculate, based on a period of time measured by the measurement unit in a first condition and a period of time measured by the measurement unit in a second condition that is different from the first condition, variation of a distance between the transmission unit and the receiving unit from the first condition to the second condition, to thereby control the image forming condition of the image forming unit in accordance with the calculated variation of the distance and the value of the first signal.

Further features of the present invention will become apparent from the following description of embodiments with reference to the attached drawings.

DESCRIPTION OF THE EMBODIMENTS

Now, embodiments of the present invention are described with reference to the drawings. However, it is to be understood that the embodiments described below are only examples and are not intended to limit the scope of the present invention thereto.

First Embodiment

Outline of Configuration and Operation of Image Forming Apparatus

Figure 1:
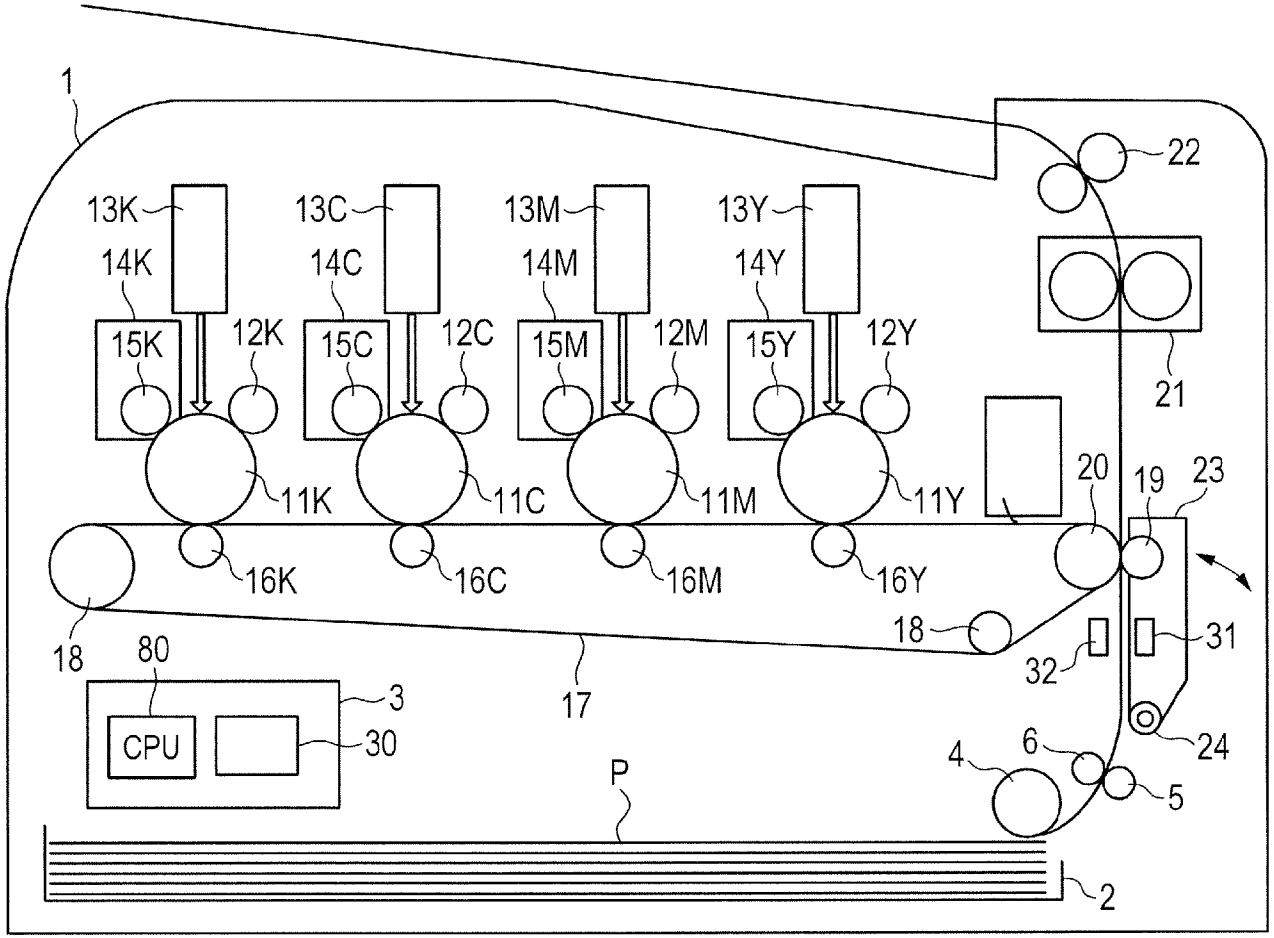
FIG. 1 is a schematic sectional view illustrating an image forming apparatus according to each of first to third embodiments of the present invention.

FIG. 1 is a schematic sectional view illustrating, as an example of an electrophotographic color image forming apparatus according to this embodiment, an image forming apparatus 1 of a tandem type (four-drum type) that has a basis weight detection sensor mounted thereon and employs an intermediate transfer belt method. In FIG. 1, a supply cassette 2 receives a recording medium P. An image forming control unit 3 controls an image forming operation of the image forming apparatus 1. A supply roller 4 supplies the recording medium P from the supply cassette 2, and a conveyance roller 5 and a conveyance counter roller 6 convey the supplied recording medium P. Photosensitive drums 11Y, 11M, 11C, and 11K serving as image bearing members respectively bear toner images of yellow (Y), magenta (M), cyan (C), and black (K). Description of symbols Y, M, C, and K representing the respective colors is hereinafter omitted unless necessary. A charge roller is a primary charging unit configured to uniformly charge the photosensitive drums 11 to a predetermined potential. An optical unit 13 is an optical unit configured to form an electrostatic latent image by irradiating the photosensitive drum 11 charged by the charge roller 12 with a laser beam corresponding to the image data of each color. A developing device 14 makes visible the electrostatic latent image formed on the photosensitive drum (image bearing member) 11 by toner (developer). A developer conveyance roller 15 feeds a developer in the developing device 14 to a portion facing the photosensitive drum 11. The photosensitive drum 11, the charge roller 12, the optical unit 13, and the developing device 14 construct an image forming portion. A primary transfer roller 16 transfers the image formed on the photosensitive drum 11 onto an intermediate transfer belt 17. A driving roller 18 drives the intermediate transfer belt 17 that bears the image transferred from the photosensitive drum 11. A secondary transfer roller 19 is a roller for transferring the image formed on the intermediate transfer belt 17 onto the recording medium P, and a secondary transfer counter roller 20 is a roller facing the secondary transfer roller 19. A fixing unit 21 melts and fixes the tonner image transferred onto the recording medium P while conveying the recording medium P. A discharge roller 22 discharges the recording medium P having the image fixed thereon by the fixing unit 21.

Next, the image forming operation of the image forming apparatus 1 is described. The image forming control unit 3 includes a central processing unit (CPU) 80 configured as a control unit to collectively control the image forming operation of the image forming apparatus 1. Print data including a printing command or image information is input to the image forming control unit 3 from a host computer or the like (not shown). The image forming apparatus 1, which has received the print data, starts a printing operation, and the recording medium P is supplied from the supply cassette 2 and fed to the conveyance path by the supply roller 4. In order to synchronize the timing of the forming operation of an image to be transferred onto the intermediate transfer belt 17 with the timing of the conveyance operation of the recording medium P, the recording medium P temporarily stops at the position of the conveyance roller 5 and the conveyance counter roller 6, and stands by until the image is formed. Along with the supplying operation of the recording medium P, as the image forming operation, the photosensitive drum 11 is charged to a fixed potential by the charge roller 12. Based on the input print data, the optical unit 13 forms an electrostatic latent image by performing exposure scanning of a charged surface of the photosensitive drum 11 with a laser beam. To make the formed electrostatic latent image visible, development is carried out by the developing device 4 and the developer conveyance roller 15. In other words, the electrostatic latent image formed on the surface of the photosensitive drum 11 is developed as a toner image of each color by toner supplied from the developing device 14. The photosensitive drum 11 abuts on the intermediate transfer belt 17, and rotates in synchronization with rotation of the intermediate transfer belt 17. The respective developed toner images are sequentially multiple-transferred onto the intermediate transfer belt 17 by the primary transfer roller 16. Then, the toner image formed on the intermediate transfer belt 17 is transferred onto the recording medium P by the secondary transfer roller 19 and the secondary transfer counter roller 20. The toner image transferred onto the recording medium P is fixed onto the recording medium P by the fixing unit 21 constructed of a fixing roller or the like. The recording medium P having the toner image fixed thereon is discharged to a discharge tray (not shown) by the discharge roller 22, and the image forming operation is ended.

[Basis Weight Detection Sensor]

In FIG. 1, a transmission unit 31 serving as a transmission unit and a receiving unit 32 serving as a receiving unit of the basis weight detection sensor that is a recording medium determination apparatus for detecting basis weight information of the recording medium P are arranged so as to sandwich the conveyance path on which the recording medium P is conveyed. Positions of the transmission unit 31 and the receiving unit 32 arranged on the conveyance path are closer to a conveyance direction upstream side of the recording medium P on the conveyance path than to the secondary transfer roller 19 and the secondary transfer counter roller 20 constructing the transfer portion. The transmission unit 31 is installed together with the secondary transfer roller 19 within the secondary transfer unit 23. The arrangement positions of the transmission unit 31 and the receiving unit 32 may be switched from one to another to install the receiving unit 32 within the secondary transfer unit 23. The secondary transfer unit 23 is movable to be opened/closed in the illustrated arrow direction with a secondary transfer unit rotational axis 24 set as a supporting point. This enables, even when the recording medium P being conveyed stays near the secondary transfer unit 23, a user to easily remove the retained recording medium P by opening the secondary transfer unit 23. The image forming control unit 3 includes a basis weight detection sensor control unit 30 configured to control transmission/reception of an ultrasonic wave (hereinafter also referred to as sonic wave) or determine the recording medium P. The "basis weight" means a mass per unit area of the recording medium P represented by $g/m^2$. The image forming control unit 3 controls image forming conditions for image formation based on a detection result of the basis weight detection sensor. The "control of image forming conditions" is, for example, changing a conveyance velocity of the recording medium P, changing a voltage applied to the secondary transfer roller 19 during transfer, or changing a temperature during fixing carried out by the fixing unit 21. Further, as an image forming condition, a rotational velocity of the primary transfer roller 16 or the secondary transfer roller 19 during transfer of the image may be controlled. As an image forming condition, a rotational velocity of the fixing roller included in the fixing unit 21 during fixing of the image may be controlled.

The transmission unit 31 and the receiving unit 32 of the basis weight detection sensor are similar in configuration, and each include a piezoelectric element (or piezo element) for mutually converting between mechanical displacement and an electric signal, and an electrode terminal. In the transmission unit 31, when a pulse voltage of a predetermined frequency is applied to the electrode terminal, the piezoelectric element oscillates to generate a sonic wave. When the recording medium P is present in the midway, the generated sonic wave is transmitted in air to reach the recording medium P. When the sonic wave has reached the recording medium P, the recording medium P vibrates due to the sonic wave. When the recording medium P vibrates, the sonic wave is further transmitted in air to reach the receiving unit 32. The sonic wave transmitted from the transmission unit 31 is attenuated via the recording medium P to reach the receiving unit 32 in this manner. The piezoelectric element of the receiving unit 32 outputs an output voltage corresponding to amplitude of the received sonic wave to the electrode terminal. An operation principle for transmitting/receiving the ultrasonic wave by using the piezoelectric element has been described.

[Configuration of Basis Weight Detection Sensor]

Figure 2A:
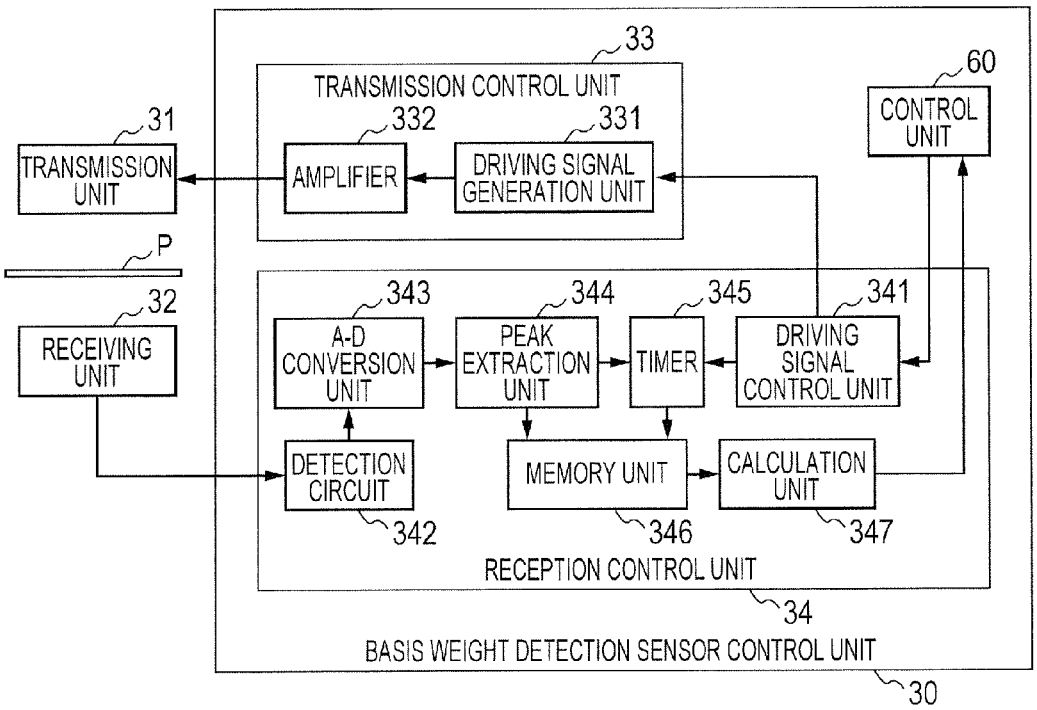
FIG. 2A is a block diagram illustrating a configuration of a basis weight detection sensor according to the first embodiment.
Figure 2B:
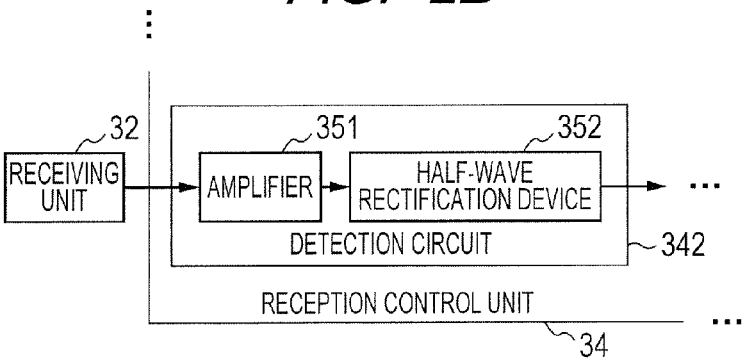
FIG. 2B is a block diagram illustrating the configuration of the basis weight detection sensor according to the first embodiment.

Next, a configuration of the basis weight detection sensor and a method of detecting basis weight of the recording medium P by the basis weight detection sensor are described referring to FIGS. 2A and 2B. FIG. 2A is a block diagram illustrating the configuration of the basis weight detection sensor. As illustrated in FIG. 2A, the basis weight detection sensor includes the transmission unit 31, the receiving unit 32, and the basis weight detection sensor control unit 30. The basis weight detection sensor control unit 30 includes a transmission control unit 33, a reception control unit 34, and a control unit 60. The transmission control unit 33 has a function of generating a driving signal for transmitting an ultrasonic wave and amplifying the driving signal. The reception control unit 34 has a function of detecting amplitude of the ultrasonic wave received by the receiving unit 32 and converting the ultrasonic wave into a voltage signal. The control unit 60 controls each unit and determines a recording medium. The control unit 60 includes a read-only memory (ROM) and a random access memory (RAM) (not shown). The ROM stores a program or data for controlling the basis weight detection sensor, and the RAM is a memory used for temporarily storing information by a control program executed by the control unit 60. According to this embodiment, the transmission unit 31 and the receiving unit 32 respectively transmits and receives an ultrasonic wave having a frequency of 32 kHz. A frequency of an ultrasonic wave to be generated is set in advance based on the configurations of the transmission unit 31 and the receiving unit 32, detection accuracy or the like, and a frequency may be selected from an appropriate range. FIG. 2B is a block diagram illustrating a configuration of a detection circuit 342 of the reception control unit 34. The detection circuit 342 includes an amplifier 351 and a half-wave rectification device 352.

In FIG. 2A, when measuring basis weight of the recording medium P, the control unit 60 outputs an instruction signal for starting a measurement to a driving signal control unit 341 of the reception control unit 34. The driving signal control unit 341, which has received the input instruction signal for starting the measurement, instructs a driving signal generation unit 331 of the transmission control unit 33 to generate an ultrasonic wave signal in order to transmit an ultrasonic wave of a predetermined frequency. To reduce the influence of disturbance such as a reflected wave caused by the recording medium P or a member around the conveyance path, the driving signal control unit 341 outputs a pulse wave (burst wave) of a fixed period (described below referring to FIG. 3A) so that only a direct wave radiated from the transmission unit 31 can be received by the receiving unit 32. According to this embodiment, by one measurement, a pulse wave (driving signal) having a frequency of 32 kilo hertz (kHz) is continuously output by 5 pulses for every 10 milliseconds (ms), and this is repeated 16 times. Along with the outputting of the pulse wave, a timer 345 serving as a counter is reset, and counting is started. The driving signal generation unit 331 serving as a generation unit generates a driving signal as a pulse wave of a predetermined frequency, and outputs the driving signal to the amplifier 332. The amplifier 332 amplifies a level (voltage value) of the driving signal input by the driving signal generation unit 331 to output the signal to the transmission unit 31.

In an absent condition of the recording medium P between the transmission unit 31 and the receiving unit 32, the receiving unit 32 receives an ultrasonic wave that is transmitted from the transmission unit 31 but not passed through the recording medium P, and outputs a reception signal waveform (second signal) to the detection circuit 342 of the reception control unit 34. In a present condition of the recording medium P between the transmission unit 31 and the receiving unit 32, the receiving unit 32 receives an ultrasonic wave that is transmitted from the transmission unit 31 and is attenuated via the recording medium P, and outputs a reception signal waveform (first signal) to the detection circuit 342 of the reception control unit 34. As illustrated in FIG. 2B, the detection circuit 342 includes the amplifier 351 for amplifying the input signal and the half-wave rectification device 352 for half-wave rectifying the signal. The amplifier 351 according to this embodiment can change an amplification rate of the received signal between the present condition and the absent condition of the recording medium P between the transmission unit 31 and the receiving unit 32.

Figure 3A:
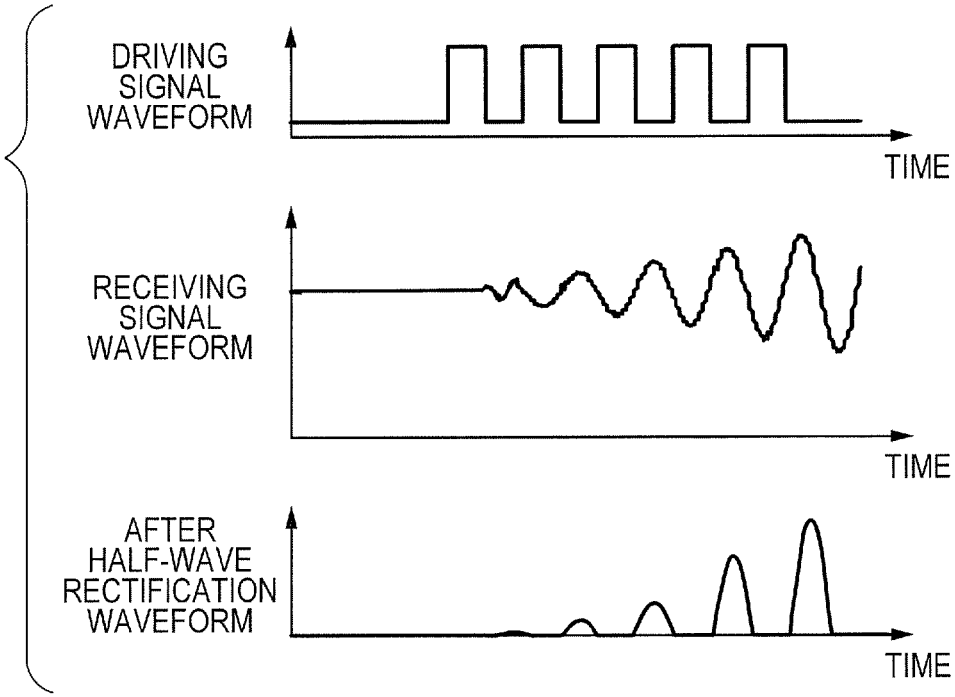
FIG. 3A is a graph showing a signal waveform of the basis weight detection sensor according to the first embodiment.

FIG. 3A is a graph showing a signal waveform in each unit illustrated in FIGS. 2A and 2B. In FIG. 3A, a "driving signal waveform" is a waveform of a pulse wave output from the driving signal generation unit 331 of the transmission control unit 33 to the amplifier 332, and a "reception signal waveform" is a waveform of a signal transmitted from the transmission unit 31 and received by the receiving unit 32. A "half-wave rectification" is a waveform of a signal output from the half-wave rectification device 352 of the detection circuit 342 of the reception control unit 34. Each horizontal axis indicates time.

An analog signal (signal of half-wave rectification shown in FIG. 3A) output from the detection circuit 342 is input to an analog-digital (A-D) conversion unit 343 to be converted into a digital signal. A peak extraction unit 344 serving as a detection unit detects and extracts, based on the converted digital signal, a peak value (maximum value) of the signal received by the receiving unit 32 (hereinafter also simply referred to as peak value). As described above, at the timer 345 that is a measurement unit, the timer serving as the counter is reset at timing of outputting the driving signal from the driving signal generation unit 331 to start counting. The peak extraction unit 344 executes time-sequential signal processing, and reads a counter value from the timer 345 at timing of detecting the peak value of the received signal. At end timing of one measurement, the peak value of the signal extracted by the peak extraction unit 344 and the counter value read by the timer 345 are stored as a set in a storage unit 346. This measuring operation is carried out in the absent condition of the recording medium P between the transmission unit 31 and the receiving unit 32 (hereinafter also referred to as absent condition of recording medium P) and in the present condition of the recording medium P between the transmission unit 31 and the receiving unit 32 (hereinafter also referred to as present condition of recording medium P). A calculation unit 347 calculates a calculation coefficient from the obtained value. The "calculation coefficient" is a value corresponding to basis weight calculated from a ratio of peak values in the absent and present conditions of the recording medium P, and is used for determining basis weight of the recording medium P. The control unit 60 serving as the control unit determines the basis weight of the recording medium P based on the calculation coefficient calculated by the calculation unit 347, and the CPU 80 of the image forming apparatus 1 controls image forming conditions based on a determination result. The CPU 80 may directly control, without determining the basis weight of the recording medium P by the control unit 60, the image forming conditions of the image forming apparatus 1 based on the value of the calculation coefficient.

Figure 3B:
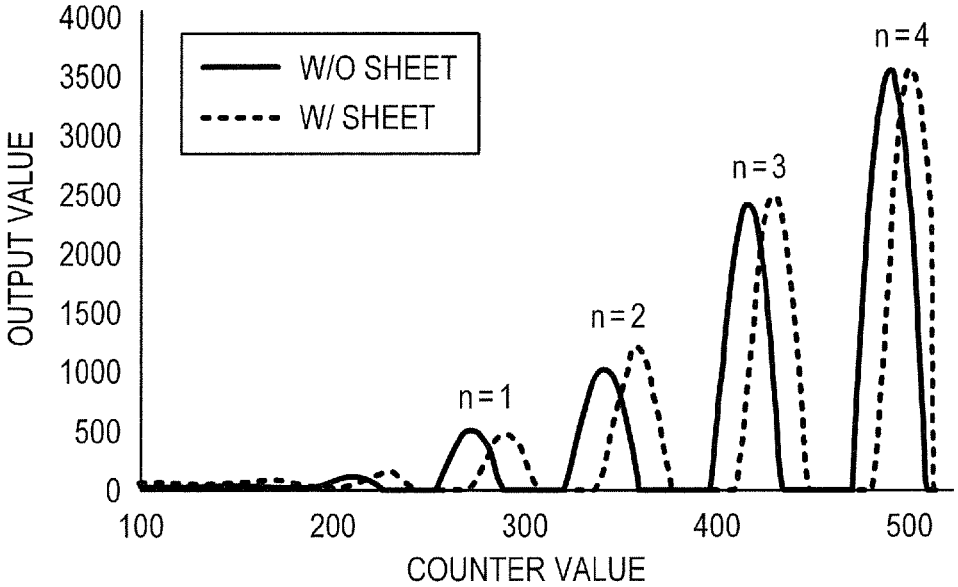
FIG. 3B is a graph showing an output signal waveform based on presence/absence of sheet.

FIG. 3B is a graph showing a signal waveform after half-wave rectification of the signal received by the receiving unit 32 according to this embodiment. A waveform indicated by a solid line is a waveform at time of "W/O sheet" in the absent condition of the recording medium P between the transmission unit 31 and the receiving unit 32 (hereinafter also referred to as time of W/O sheet or sheet absent condition). A waveform indicated by a broken line is a waveform at time of "W/ sheet" in the present condition of the recording medium P between the transmission unit 31 and the receiving unit 32 (hereinafter also referred to as time of W/ sheet or sheet present condition). The used recording medium P is a print sheet (hereinafter simply referred to as sheet) of basis weight g/m$^2$. The horizontal axis indicates a counter value corresponding to a propagation time period of the ultrasonic wave from the transmission unit 31 to the receiving unit 32, and the vertical axis indicates an output value corresponding to amplitude of the received signal. According to this embodiment, a frequency of the counter used as the timer at the timer 345 is 3 megahertz (MHz), and one count of the horizontal axis shown in FIG. 3B is 0.333 microseconds (μsec.). The output value of the vertical axis is obtained by converting the received analog signal into the digital signal and representing the converted digital signal value by 12 bits (0 to 4,905 steps). The 4,095th step that is the largest value corresponds to an amplitude voltage 3.3 V of the received signal, and 1 step is 0.806 millivolt (mV).

In the signal waveform shown in FIG. 3B, a peak (maximum value) of the output value of the signal is periodically present because the burst wave shown in FIG. 3A has been input as the driving signal to the transmission unit 31. The timing when the output value of the signal reaches a peak deviates between the presence and the absence of sheet because a propagation velocity of the ultrasonic wave is lower due to the presence of sheet. Further, the peak values of the output values are approximately equal between the time of W/O sheet and the time of W/ sheet because the amplification rate of the detection circuit 342 is changed in order to stably obtain data in the time of W/ sheet. According to this embodiment, the amplification rate in the time of W/ sheet is set to be 16 times higher. When the ultrasonic wave is transmitted from the transmission unit 31, the ultrasonic wave is synthesized with a reflected wave to be amplified, thus increasing the amplitude of the signal received by the receiving unit 31. As shown in FIG. 3B, the peak value of the received signal at first two periods (waveforms of n=1, 2 shown) is small, and a stable peak value may not be obtained depending on presence/absence of sheet or a type of sheet. Thus, to detect basis weight of the sheet, as in the case of a received signal of a next two periods (waveforms of n=3, 4 shown), a peak value sufficient for basis weight detection needs to be obtained. When time elapses after the transmission of the ultrasonic wave, disturbance such as a reflected wave has an influence. It is therefore desired to obtain a peak value of an output value within a range where necessary amplitude of the received signal can be obtained as early as possible. Thus, this embodiment is described by using a signal peak value of n=3 shown in FIG. 3B. To obtain the signal peak value of n=3, for example, a maximum value may be extracted within a predetermined time period after the transmission of the ultrasonic wave. As used herein, the predetermined time period is longer than the period of time where a signal peak value of n=2 may be detected and shorter than the period of time where a signal peak value of n=4 may be detected. In FIG. 3B, for example, this predetermined time period can be defined as the period of time until a counter value 450 is reached.

[Correction of Atmospheric Pressure Variation]

Figure 4A:
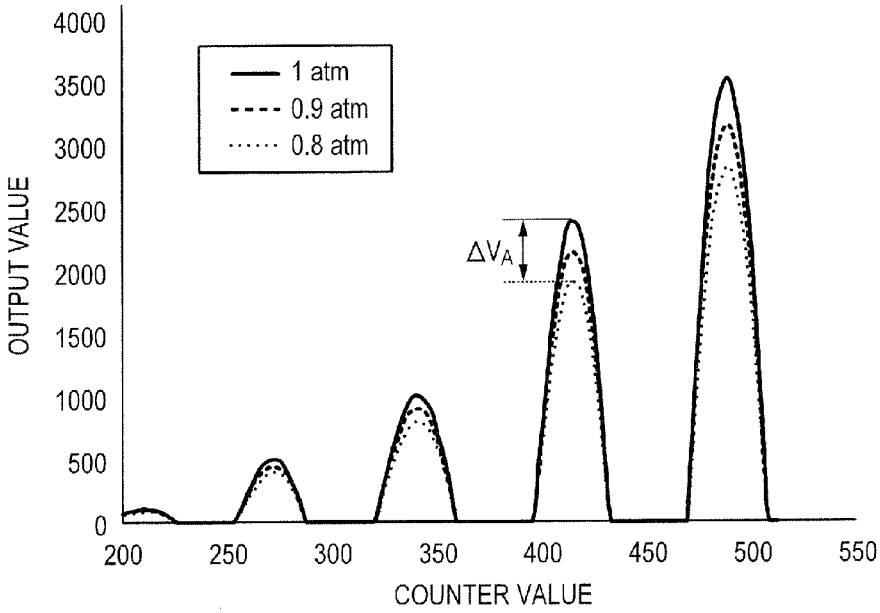
FIGS. 4A and 4B are graphs each showing the influence of atmospheric pressure variation on basis weight determination accuracy according to the first embodiment.
Figure 4B:
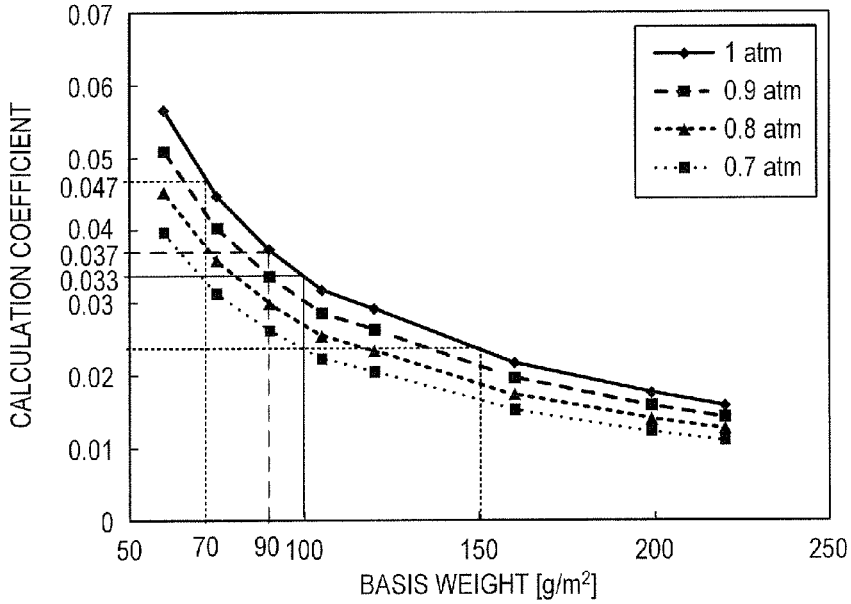

Next, the influence of atmospheric pressure variation on basis weight determination accuracy and a method of correcting the atmospheric pressure variation are described referring to FIGS. 4A and 4B. FIG. 4A is a graph showing a change of the output value of the basis weight detection sensor caused by atmospheric pressure in the sheet absent condition. In FIG. 4A, as in the case shown in FIG. 3B, the horizontal axis indicates a counter value corresponding to a propagation time period of the ultrasonic wave from the transmission unit 31 to the receiving unit 32, and the vertical axis indicates an output value corresponding to amplitude of a signal that is the received ultrasonic wave. A graph indicated by a solid line shows a reception signal waveform when atmospheric pressure is 1 atm, a graph indicated by a thick dotted line shows a reception signal waveform when atmospheric pressure is 0.9 atm, and a graph indicated by a thin dotted line shows a reception signal waveform when atmospheric pressure is 0.8 atm. The "atm" is a unit for representing atmospheric pressure, and 1 atm is $1.013\times10^5$ pascal (Pa). The output values of the respective signal waveforms were measured by changing the atmospheric pressure under the condition that the driving signal level of the transmission unit 31 was constant. As shown in FIG. 4A, as the atmospheric pressure (atm) is lower, the output value that is amplitude of the received signal at the receiving unit 32 is attenuated more at the constant driving signal level. In FIG. 4A, there is shown a difference $\Delta V_A$ (attenuation amount) in output value between when the atmospheric pressure is 1 atm and when the atmospheric pressure is 0.8 atm at n=3.

Further, when the atmospheric pressure changes, the calculation coefficient also changes. FIG. 4B is a graph showing the influence of atmospheric pressure variation on basis weight determination accuracy, specifically, a relationship between basis weight and the calculation coefficient at each atmospheric pressure (1 atm (solid line), 0.9 atm (long-pitch broken line), 0.8 atm (short-pitch broken line), and 0.7 atm (dotted line)). In FIG. 4B, the horizontal axis indicates basis weight (g/m$^2$) of a sheet, and the vertical axis indicates the calculation coefficient. The calculation coefficient $\tau$ is represented by Expression (1), where Vp is a peak value of the output value of the received signal at the receiving unit 32 (hereinafter referred to as peak value) in the sheet present condition, and Va is a peak value in the sheet absent condition:

$$\tau = Vp/Va \tag{1}$$

For example, when basis weight determination of a sheet having equal basis weight 100 g/m$^2$ is carried out at the atmospheric pressure of 1 atm and the atmospheric pressure of 0.7 atm in FIG. 4B, the calculation coefficient is smaller at 0.7 atm than that at 1 atm. Thus, when basis weight determination is carried out by using the calculation coefficient at the atmospheric pressure of 0.7 atm as the calculation coefficient at the atmospheric pressure of 1 atm, the basis weight is mistakenly determined to be 150 g/m$^2$. Therefore, in order to correctly determine the basis weight of the sheet, the calculation coefficient $\tau$ needs to be corrected in view of the atmospheric pressure variation. The output value of the basis weight detection sensor changes due to the atmospheric pressure because a transmission difficulty of sound (acoustic impedance) changes depending on a density of air. Since the output value of the basis weight detection sensor is proportional to the acoustic impedance, the atmospheric pressure variation can be corrected based on a ratio of output values (peak values) before and after the atmospheric pressure variation. According to a specific method, first, in a circumstance such as the time of factory shipment (first condition) where atmospheric pressure is known in advance, detection is carried out in the sheet absent condition, and a measured peak value is stored as a reference peak value $Va_0$ in the storage unit 346 or the like. According to this embodiment, a circumstance for measuring the reference peak value is 1 atm. This measurement circumstance is an example, and the atmospheric pressure for measuring the reference peak value $Va_0$ may be arbitrarily set. Then, when the surrounding circumstance may have varied after the factory shipment (second condition), detection is carried out in the sheet absent condition as in the case of the time of the factory shipment. A ratio of the measured peak value Va to the reference peak value $Va_0$ stored in the storage unit 346 is set as a correction coefficient, and the calculation coefficient $\tau$ can be corrected by using the correction coefficient. When the correction coefficient is set as a circumstance correction coefficient $\alpha$ and the peak value in the sheet absent condition is set as the reference peak value $Va_0$, the circumstance correction coefficient $\alpha$ can be represented by Expression (2):

$$\alpha = Va/Va_0 \tag{2}$$

The calculation coefficient $\tau_r$ at the atmospheric pressure of 1 atm is represented by Expression (3):

$$\tau_r=\tau/\alpha \quad (3)$$

Thus, by performing correction based on the circumstance correction coefficient $\alpha$, the calculation coefficient $\tau_r$ at the atmospheric pressure of 1 atm can be obtained, and correct basis weight determination can be carried out.

[Correction of Distance Variation]

The output of the basis weight detection sensor is affected not only by the atmospheric pressure variation but also by a positional relationship (distance) between the transmission unit 31 and the receiving unit 32. In other words, because the sonic wave generated by the transmission unit 31 is attenuated more as a distance from the transmission unit 31 is larger, the amplitude of the received ultrasonic wave changes (is attenuated) depending on a position of the receiving unit 32. As described above referring to FIG. 1, the transmission unit 31 and the receiving unit 32 are arranged so as to sandwich the conveyance path on which the recording medium P is conveyed, and the transmission unit 31 is disposed in the secondary transfer unit 23. When the recording medium P stays on the midway of the conveyance path or the like, if the secondary transfer unit 23 is opened/closed so as to remove the retained recording medium P, the position of the transmission unit 31 deviates from a position before the opening/closing to vary its distance from the receiving unit 32 (hereinafter referred to as distance variation).

Figure 5A:
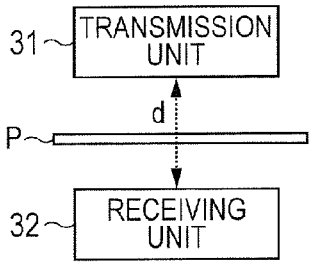
FIGS. 5A, 5B and 5C are diagrams and a graph each showing the influence of distance variation on an output of the basis weight detection sensor according to the first embodiment.
Figure 5B:
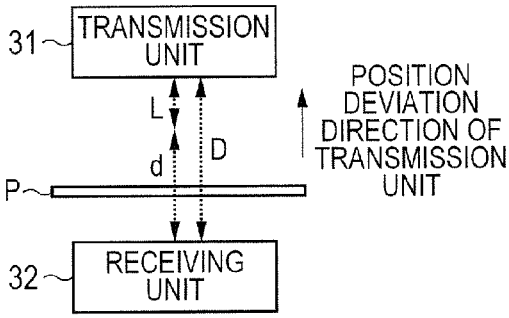
Figure 5C:
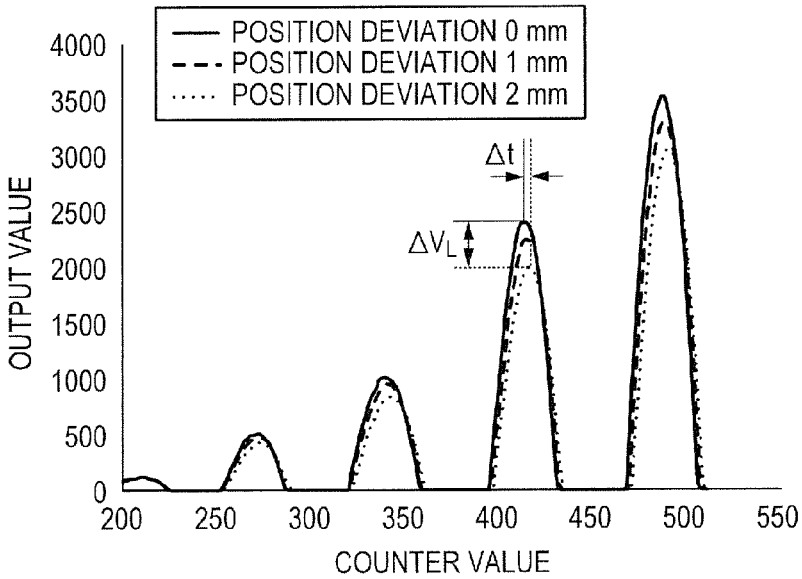

Next, the influence of the distance variation is described referring to FIGS. 5A to 5C. FIGS. 5A and 5B are diagrams each illustrating a positional relationship among the transmission unit 31 and the receiving unit 32 of the basis weight detection sensor and the recording medium P. FIG. 5A illustrates an undeviating condition of the position of the transmission unit 31, while FIG. 5B illustrates a deviating condition of the position of the transmission unit 31 due to the open/close operation of the secondary transfer unit 23. As used herein, a distance d is a distance between the transmission unit 31 and the receiving unit 32 in the undeviating condition of the position of the transmission unit 31. A distance D is a distance between the transmission unit 31 and the receiving unit 32 in the deviating condition of the position of the transmission unit 31. The distance between the transmission unit 31 and the receiving unit 32 represents a distance between a center of the transmission unit 31 and a center of the receiving unit 32. In other words, it is a distance between a center of the piezoelectric element included in the transmission unit 31 to transmit the ultrasonic wave and a center of the piezoelectric element included in the receiving unit 32 to receive the ultrasonic wave. L represents a difference between the distance between the transmission unit 31 and the receiving unit 32 in the deviating condition of the position of the transmission unit 31 and the distance between the transmission unit 31 and the receiving unit 32 in the undeviating condition of the position of the transmission unit 31. In other words, a relationship of L=D−d is established. This embodiment is described assuming that the position deviates in the arrow direction illustrated in FIG. 5B. Even when the position deviates in a direction other than the arrow direction, if the distance between the transmission unit 31 and the receiving unit 32 is changed, outputting of the received signal from the receiving unit 32 is similarly affected.

FIG. 5C is a graph showing a change of the output value of the signal received by the receiving unit 32. The horizontal axis indicates a counter value corresponding to a propagation time period of the ultrasonic wave from the transmission unit 31 to the receiving unit 32, and the vertical axis indicates an output value corresponding to amplitude of a signal that is the received ultrasonic wave. In FIG. 5C, a graph indicated by a solid line shows a signal waveform when a distance variation amount L is 0 millimeter (mm), a graph indicated by a broken line shows a signal waveform when a distance variation amount L is 1 mm, and a graph indicated by a dotted line shows a signal waveform when a distance variation amount L is 2 mm. As used herein, the distance variation is in a direction along which the transmission unit 31 and the receiving unit 32 are away from each other. The signal waveforms shown in FIG. 5C are signal waveforms measured in the sheet absent condition. In the case of the signal waveform indicated by the solid line when there is no distance variation, as a deviation amount is larger, the distance D between the transmission unit 31 and the receiving unit 32 is longer. It can therefore be understood that the output value is attenuated. For example, FIG. 5C shows an attenuation amount of the output value (difference) $\Delta V_L$ between when the distance variation amount L is 0 mm (solid line) and when the distance variation amount L is 2 mm (thin dotted line).

Now, a correction method when atmospheric pressure variation and distance variation simultaneously occur is described. According to the above-mentioned correction method of the atmospheric pressure variation, the circumstance correction coefficient $\alpha$ is calculated based on the peak value Va that is the output value in the sheet absent condition (hereinafter also referred to as output value) and the reference peak value $Va_0$, and the calculation coefficient $\tau$ is corrected based on the circumstance correction coefficient $\alpha$ to calculate the calculation coefficient $\tau_r$ at the atmospheric pressure of 1 atm. However, when the distance variation occurs simultaneously with the atmospheric pressure variation, the output value (peak value) varies also due to the influence of the distance variation, resulting in a failure to perform correct comparison with the reference peak value $Va_0$.

Thus, even when the atmospheric pressure variation and the distance variation simultaneously occur, it is required to remove, among variation amounts of the output values in the sheet absent condition, a variation amount caused by the influence of the distance variation, and calculate an output value having only a variation amount caused by the influence of the atmospheric pressure variation added thereto. Note that variation of the output value due to the distance variation occurs at the same rate in the absence and presence conditions of sheet, and thus the calculation coefficient $\tau$ does not change. Therefore, correction of the calculation coefficient $\tau$ based on the distance variation is unnecessary.

A method of removing the influence of the distance variation is described referring to FIG. 5C. The counter value of the horizontal axis shown in FIG. 5C is a counter value (lapse of time) from the time when the driving signal is generated by the transmission control unit 33, and the ultrasonic wave transmitted from the transmission unit 31 reaches the receiving unit 32 to the time when the peak value of the received signal is extracted at the reception control unit 34. In other words, the counter value is a value that corresponds to the propagation time period of the ultrasonic wave and changes depending on the distance D between the transmission unit 31 and the receiving unit 32 of the basis weight detection sensor. As can be understood from FIG. 5C, because the time for reaching the peak value changes depending on the distance variation amount L, the distance variation amount L can be calculated by measuring this variation amount. FIG. 5C shows a change amount (difference amount) Δt of time for reaching the peak value between when the distance variation amount L is 0 mm (solid line) and when the distance variation amount L is 2 mm (dotted line). For example, first, detection is carried out in the sheet absent condition at the time of factory shipment or the like, and a counter value that is a measurement result is stored as reference time $t_0$ in the storage unit such as the storage unit 346 in the image forming apparatus. Then, after the shipment, detection is carried out when the position of the transmission unit 31 of the basis weight detection sensor may have changed due to an open/close operation of the secondary transfer unit 23 and, by comparing the measured counter value with the reference time $t_0$, the distance variation amount L can be obtained.

The distance d in the undeviating position of the transmission unit 31 and the distance D in the deviating position of the transmission unit 31 are respectively represented by Expressions (4) and (5). In Expressions (4) and (5), $t_0$ is reference time, $v_0$ is a propagation velocity (sonic velocity) of the ultrasonic wave, f is a frequency of the counter, and t is a counter value measured by the counter.

$$d=t_0\times v_0/f \tag{4}$$

$$D=t\times v_0/f \tag{5}$$

Accordingly, the distance variation amount L can be calculated by Expression (6):

$$L=D-d=(t-t_0)\times v_0/f \tag{6}$$

At this stage, the output value of the received signal in the condition of the distance variation amount L is (1-βL) times larger than the output value in the undeviating position, where β is an attenuation rate of the output value with respect to the distance variation amount L. Therefore, the influence of the distance variation is removed, and an output value Va' in the sheet absent condition only affected by the atmospheric variation can be calculated by Expression (7):

$$Va'=Va/(1-\beta L) \tag{7}$$

A value of β needs to be calculated in advance by measuring attenuation of the output value with respect to the distance variation, and the calculated attenuation rate β of the output value needs to be stored in the storage unit 346 or the like. From Expression (7), when there is the distance variation, the circumstance correction coefficient α represented by Expression (2) may be rewritten to that represented by Expression (8):

$$\alpha=Va'/Va_0 \tag{8}$$

[Specific Example of Basis Weight Calculation]

In order to describe a difference in determination result of basis weight between when a change of the propagation time period is not detected and when the change is detected, a specific example of basis weight calculation is described. In the basis weight detection sensor, a distance d is set to d=9 mm, a frequency f of the counter for measuring the propagation time period is set to f=3 MHz, and an attenuation rate β of the output value with respect to the distance variation amount L is set to β=0.1. Under circumstance conditions of the propagation velocity (sonic velocity) $v_0$ of the ultrasonic wave set to $v_0$=340 m/s and atmospheric pressure set to 0.8 atm, basis weight detection of a sheet having basis weight of 100 g/m$^2$ is carried out. For measurement values at this time, a measured counter value t of the counter is t=90, a measured peak value Va in the sheet absent condition is Va=1.5 V, and a measured peak value Vp in the sheet present condition is Vp=0.042 V. When a calculation coefficient τ is calculated by using Expression (1), τ=0.028 is obtained. Reference time $t_0$ that is a counter value of the counter when detection is carried out in the sheet absent condition at the time of factory shipment (that is, distance variation amount is 0 mm, and atmospheric pressure is 1 atm) is $t_0$=80, and a peak value $Va_0$ in the sheet absent condition is $Va_0$=2 V.

First, when the change of the propagation time period is not detected (distance variation amount L is L=0 mm), by using Expression (2), a circumstance correction coefficient α is calculated to be α=0.75. Then, by using the calculated calculation coefficient τ and the calculated circumstance correction coefficient α, a calculation coefficient $\tau_r$ at atmospheric pressure of 1 atm is calculated by Expression (3) to be $\tau_r$=0.037. When the obtained calculation coefficient $\tau_r$=0.037 at the atmospheric pressure of 1 atm is collated with that shown in FIG. 4B, basis weight is erroneously detected to be 90 g/m$^2$.

On the other hand, when a change of the propagation time period is detected, the processing is as follows. First, by using Expression (6), a distance variation amount L is calculated to be L=1.1 mm. Then, by substituting the measured peak value Va in the sheet absent condition, the attenuation rate β of the output value with respect to the distance variation amount L, and the distance variation amount L for Expression (7), an output value Va' in the sheet absent condition affected only by the atmospheric pressure variation is obtained. Then, by using the output value Va' in the sheet absent condition affected only by the atmospheric pressure variation and the reference peak value $Va_0$, a circumstance correction coefficient α is calculated by Expression (8) to be α=0.842. Then, by using the calculated calculation coefficient τ and the calculated circumstance correction coefficient α, a calculation coefficient $\tau_r$ at atmospheric pressure of 1 atm is calculated by Expression (3) to be $\tau_r$=0.033. When this result is collated with that shown in FIG. 4B, basis weight is correctly determined to be 100 g/m$^2$.

[Control Sequence]

Figure 6:
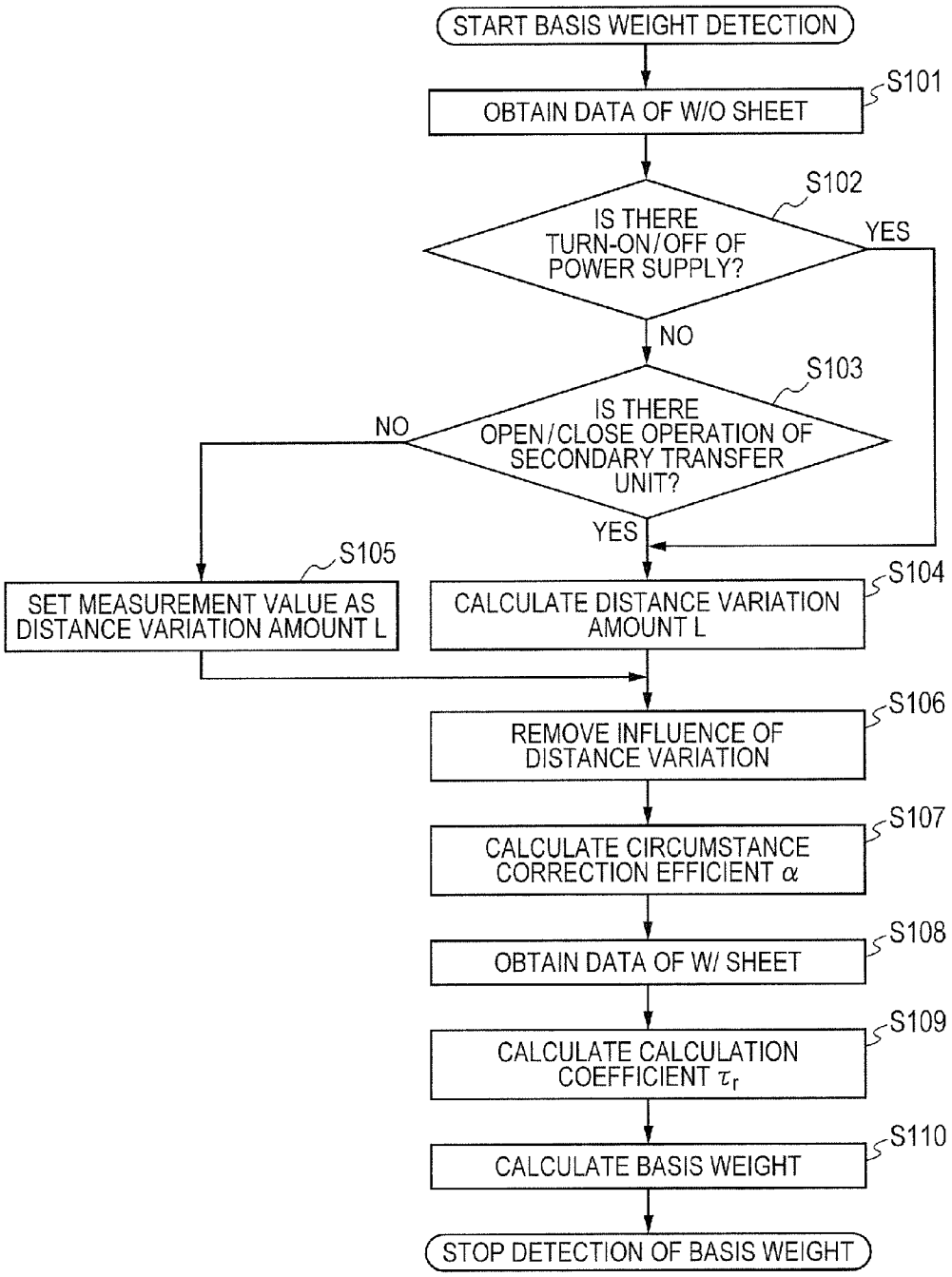
FIG. 6 is a flowchart illustrating a control sequence of basis weight detection according to the first embodiment.

Next, referring to FIG. 6, a method of determining the basis weight of the recording medium P according to this embodiment is described. FIG. 6 is a flowchart illustrating a control sequence of the control unit 60 of the basis weight detection sensor for determining the basis weight of the recording medium P. FIG. 6 illustrates the control sequence performed by the control unit 60 of the basis weight detection sensor. In the control unit 60, acquisition (e.g., power ON/OFF) of information from the CPU 80 of the image forming apparatus 1 may be necessary. However, description of an information transfer sequence with the CPU 80 is omitted here. For basis weight calculation, parameters measured in advance and stored in the storage unit 346 of the basis weight detection sensor are as follows. The distance d between the transmission unit 31 and the receiving unit 32 when the distance variation amount is 0 mm, the propagation velocity (sonic velocity) $v_0$, the frequency f of the counter for measuring the propagation time period, the attenuation rate β of the output value with respect to the distance variation amount L, and the reference peak value $Va_0$ in the sheet absent condition are stored in the storage unit 346. The reference time $t_0$ that is the counter value of the counter when the detection is carried out in the sheet absent condition at the time of factory shipment (distance variation amount is 0 mm, and atmospheric pressure is 1 atm) is also stored in the storage unit 346. Further, the table including the data of the graph shown in FIG. 4B, namely, data associating with each other the atmospheric pressure, the calculation coefficient, and the basis weight, is stored in the storage unit 346.

The control unit 60 of the basis weight detection sensor starts basis weight detection when the image forming apparatus 1 starts image formation. In Step S101, the control unit 60 carries out detection of a received signal of an ultrasonic wave in a sheet absent condition before the recording medium P is conveyed, and obtains data on a peak value Va and propagation time period t of the received signal. In Step S102, the control unit 60 obtains, from the CPU 80 of the image forming apparatus 1, information on whether the power has been turned on or off (illustrated as ON/OFF) from the time point of the last basis weight detection to determine whether the power has been turned on or off (whether there is turn-ON/OFF of power supply). When the control unit 60 determines that the power has been turned on or off (Yes in Step S102), the control unit 60 proceeds to Step S104 because of a possibility that distance variation has occurred. When the control unit 60 determines that the power has not been turned on or off (No in Step S102), the control unit 60 proceeds to Step S103. In Step S103, the control unit 60 obtains, from the CPU 80 of the image forming apparatus 1, information on whether an open/close operation of the secondary transfer unit 23 has been carried out from the time point of the last basis weight detection (whether there is any open/close operation) to determine whether the open/close operation has been carried out. When the control unit 60 determines that the open/close operation has been carried out (Yes in Step S103), the control unit 60 proceeds to Step S104 because of a possibility that distance variation has occurred. When the control unit 60 determines that the open/close operation has been not carried out (No in Step S103), the control unit 60 proceeds to Step S105.

In Step S104, because of the possibility that the distance variation has occurred, the control unit 60 calculates a distance variation amount L by using Expression (6), and proceeds to Step S106. In Step S105, because a position of the basis weight sensor may not have been changed from the last measurement time, the control unit 60 reads a value of a distance variation amount of the last measurement time stored in the storage unit 346 or the like to set it as a current distance variation amount L, and proceeds to Step S106.

In Step S106, the control unit 60 removes, by using Expression (7), the influence of the distance variation to calculate an output value Va' in the time of W/O sheet affected only by the influence of atmospheric pressure variation. In Step S107, the control unit 60 calculates a circumstance correction coefficient $\alpha$ by using Expression (8). In Step S108, the control unit 60 detects a received signal of an ultrasonic wave in the sheet present condition via the conveyed recording medium P, and obtains data on a peak value Vp and propagation time period t of the received signal in the time of W/ sheet. In Step S109, the control unit 60 calculates a calculation coefficient $\tau$ by using Expression (1), and further calculates a calculation coefficient $\tau_r$ by using Expression (3). In Step S110, the control unit 60 causes the calculation unit 347 to calculate basis weight based on the table associating with each other the atmospheric pressure, the calculation coefficient, and the basis weight stored in the storage unit 346 or the like, notifies the calculated basis weight to the CPU 80 of the image forming apparatus 1, and ends the basis weight detection processing.

In the flowchart illustrated in FIG. 6, the control unit 60 of the basis weight detection sensor controls the basis weight detection processing. However, in place of the control unit 60, the CPU 80 of the image forming apparatus 1 may perform the control. The storage location of the parameters and the table of data measured in advanced is not limited to the storage unit 346. For example, a ROM (not shown) included in the control unit 60 or a storage unit (not shown) included in the CPU 80 may be used.

As described above, according to this embodiment, reduction in correction accuracy of circumstance variation caused by the positional deviation of the basis weight detection sensor can be prevented to improve determination accuracy of the basis weight of the recording medium. In particular, by measuring the change of the propagation time period of the ultrasonic wave to remove the influence of the distance variation, correction of the calculation coefficient with respect to the atmospheric pressure variation can be accurately carried out.

Second Embodiment

The first embodiment describes the method of correcting the calculation coefficient based on the atmospheric pressure variation in the basis weight detection sensor and the distance variation between the transmission unit and the receiving unit. A second embodiment describes a method of determining basis weight based on a temperature change around a basis weight detection sensor. An image forming apparatus 1 and the basis weight detection sensor according to this embodiment are similar in configuration to those of the first embodiment, and thus description thereof is omitted. A method of controlling basis weight of a recording medium P by using the basis weight detection sensor is similar to that of the first embodiment except for a received signal processing method described below.

[Basis Weight Detection Sensor]

Figure 7A:
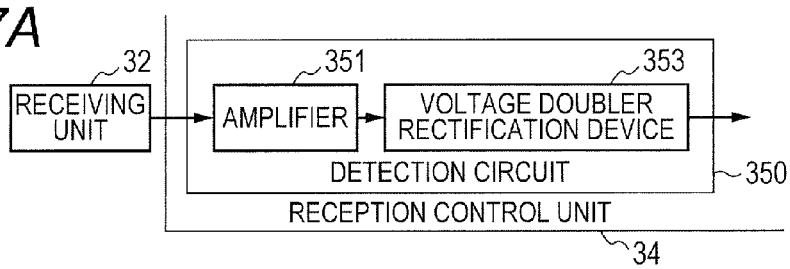
FIG. 7A is a block diagram illustrating a configuration of a detection circuit according to a second embodiment of the present invention.
Figure 7B:
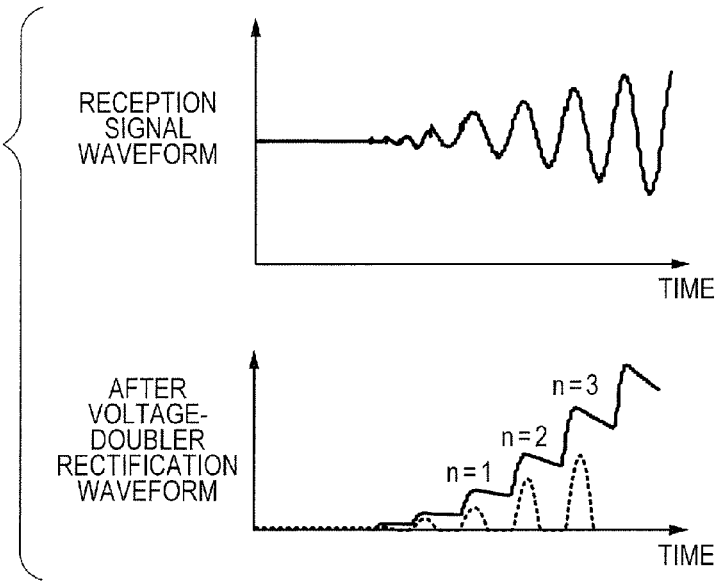
FIG. 7B is a graph showing a signal waveform of a basis weight detection sensor.

This embodiment is different from the first embodiment in configuration of a detection circuit 350 of a reception control unit 34. FIG. 7A is a block diagram illustrating the configuration of the detection circuit 350 of the reception control unit 34 in the basis weight detection sensor according to this embodiment, and specifically illustrating portions different from those illustrated in FIG. 2B. According to this embodiment, the detection circuit 350 of the reception control unit 34 includes an amplifier 351 and a voltage doubler rectification 353. A signal received by a receiving unit 32 is amplified by the amplifier 351, and then subjected to voltage doubler rectification by the voltage doubler rectification 353. FIG. 7B shows a waveform of a signal received by the receiving unit 32, and a waveform of the signal that has been subjected to the voltage doubler rectification by the voltage doubler rectification 353. Further, for comparison with the first embodiment, together with a voltage-doubler rectified signal waveform, the half-wave rectification of the first embodiment indicated by a dotted line (refer to FIG. 3A) is shown. By carrying out voltage double rectification processing, a peak value of a received signal can be increased within a short time period and, as a result, the peak value of the received signal can be detected earlier than in the case of the first embodiment. As illustrated in FIG. 7B, for example, in the half-wave rectification (dotted line), as described above, to obtain a received signal of a sufficient peak value, the processing needs to wait until reception of a signal of n=3. On the other hand, in the voltage-doubler rectified waveform, a sufficient peak value can be obtained at a received signal of n=2.

[Correction of Temperature Variation]

Figure 7C:
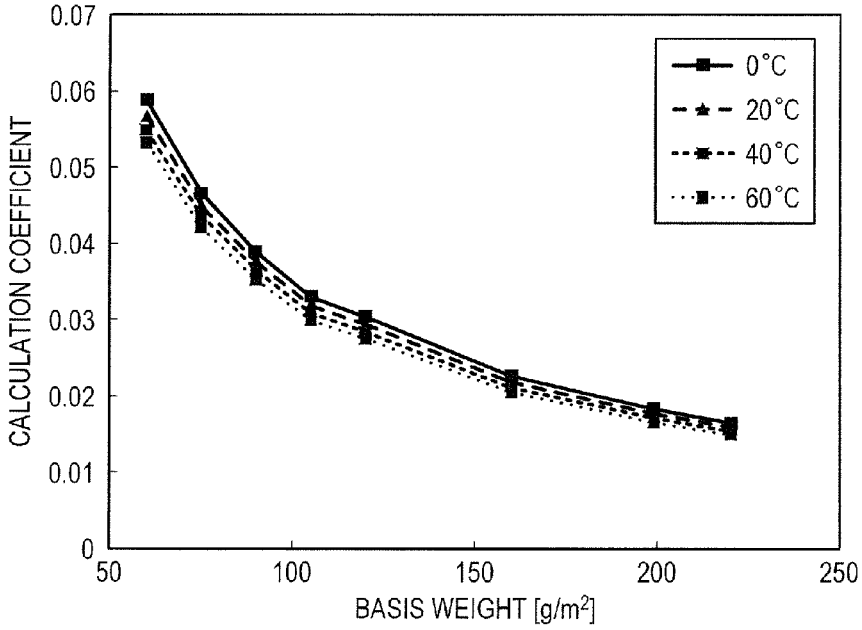
FIG. 7C is a graph showing the influence of temperature variation on basis weight determination accuracy.

Next, the method of determining basis weight according to this embodiment is described. Factors affecting an output of the basis weight detection sensor include, in addition to atmospheric pressure variation and distance variation, a temperature change around the basis weight detection sensor. As in the case of the atmospheric pressure variation, the temperature change causes a change in attenuation rate of the recording medium P. Thus, to improve determination accuracy of the basis weight, correction needs to be carried out based on a temperature change amount. FIG. 7C is a graph showing the influence of the temperature variation around the basis weight detection sensor on basis weight determination accuracy, and specifically showing relationships between basis weight and calculation coefficients at respective temperatures (0° C. (solid line), 20° C. (long-pitch broken line), 40° C. (short-pitch broken line), and 60° C. (dotted line)). In FIG. 7C, the horizontal axis indicates basis weight (g/m$^2$) of a sheet, and the vertical axis indicates a calculation coefficient. As shown in FIG. 7C, as a temperature is higher, a calculation coefficient $\tau$ is lower. A method of correcting variation of an attenuation rate with respect to the temperature change is similar to the above-mentioned method of correcting the atmospheric pressure according to the first embodiment. In other words, by using Expression (2), the variation of the attenuation rate can be corrected by using a ratio of a peak value Va measured in the sheet absent condition to a reference peak value $Va_0$ in the sheet absent condition measured at the time of factory shipment (hereinafter also referred to as peak value $Va_0$ in the sheet absent condition) as a circumstance correction coefficient $\alpha$. The reference peak value $Va_0$ in the sheet absent condition may be measured in a circumstance such as the time of factory shipment where a temperature around the basis weight detection sensor is known in advance, and stored in a storage device such as a storage unit 346 in the image forming apparatus 1. According to this embodiment, in a circumstance for measuring the reference peak value $Va_0$, a temperature in Celsius is 20° C. and atmospheric pressure is 1 atm. Note that this measurement circumstance is only an example, and a temperature and atmospheric pressure of the circumstance for measuring the reference peak value $Va_0$ may be arbitrarily set. A reason for which the atmospheric pressure variation and the temperature variation can be corrected by the same method is that the acoustic impedance described above in the first embodiment is represented by a product of a density of air that is a medium and a sonic velocity in the medium (air). As the density of air and the sonic velocity in the air change depending on atmospheric pressure and a temperature, the acoustic impedance also changes depending on atmospheric pressure and a temperature in the same manner. Therefore, when there is no distance variation, the atmospheric pressure variation and the temperature variation can be simultaneously corrected based on an output value measured in a reference circumstance (atmospheric pressure and temperature).

Next, a circumstance correction method when temperature variation, atmospheric pressure variation, and distance variation simultaneously occur is described. As described above in the first embodiment, the distance variation amount of the sensor can be calculated by using a sonic velocity (Expression (6)). Here, a sonic velocity v (velocity per second) propagated in air is generally represented by Expression (9):

$$v=331.5+0.607\times k \text{ (unit: m/s)} \tag{9}$$

Here, k represents a temperature in Celsius (° C.) around the basis weight detection sensor. 331.5 (m/s) is a sonic velocity in a circumstance at a temperature in Celsius of 0° C., and 0.607 (unit: (m/s)/° C.) is a temperature coefficient of the sonic velocity. In other words, Expression (9) shows variation of the sonic velocity v due to the temperature change, which affects detection timing of the ultrasonic wave in the basis weight detection sensor. Thus, to calculate a distance variation amount of the basis weight detection sensor from the sonic velocity, a temperature around the basis weight detection sensor needs to be measured by using a temperature sensor (not shown) such as a thermistor serving as a temperature detection unit. It is desired that the temperature sensor be arranged on a substrate on which the receiving unit 32 is mounted and near the basis weight detection sensor. By calculating the sonic velocity by Expression (9) based on the temperature information around the sensor obtained from the temperature sensor, a distance D' between the sensors when the ambient temperature changes is calculated by Expression (10):

$$D'=t\times v/f \tag{10}$$

Accordingly, a distance variation amount L when the ambient temperature changes can be calculated by Expression (11):

$$L=D'-d=1/f\,(t\times v-t_0\times v_0) \tag{11}$$

Thus, circumstance correction can be carried out by the method similar to that described above in the first embodiment.

[Specific Example of Basis Weight Calculation]

In order to describe a difference in determination result of basis weight between when a change of the propagation time period is not detected and when the change is detected, a specific example of basis weight calculation is described. In the basis weight detection sensor, the distance d is set to d=9 mm, the frequency f of the counter for measuring the propagation time period is set to f=3 MHz, and the attenuation rate $\beta$ of the output value with respect to the distance variation amount L is set to $\beta$=0.1. Under circumstance conditions where an ambient temperature k of the basis weight detection sensor is k=40° C. and the atmospheric pressure is 0.8 atm, basis weight detection of a sheet having basis weight of 100 g/m$^2$ is carried out. For measurement values at this time, a measured counter value t of the counter is t=102, a measured peak value Va in the sheet absent condition is Va=1.2 V, and a measured peak value Vp in the sheet present condition is Vp=0.034 V. When a calculation coefficient $\tau$ is calculated by using Expression (1), $\tau$=0.028 is obtained. Reference time $t_0$ that is a counter value of the counter when detection is carried out in the sheet absent condition at the time of factory shipment (distance variation amount is 0 mm, and atmospheric pressure is 1 atm) is $t_0$=80, and a peak value $Va_0$ in the sheet absent condition is $Va_0$=2 V.

First, when the change of the propagation time period is not detected (that is, distance variation amount L is L=0 mm), by using Expression (2), a circumstance correction coefficient $\alpha$ is calculated to be $\alpha$=0.6. Then, by using the calculated calculation coefficient $\tau$ and the calculated circumstance correction coefficient $\alpha$, a calculation coefficient $\tau_r$ at the atmospheric pressure of 1 atm is calculated by Expression (3) to be $\tau_r$=0.047. When the obtained calculation coefficient $\tau_r$=0.047 at the atmospheric pressure of 1 atm is collated with that shown in FIG. 4B, basis weight is erroneously detected to be 70 g/m$^2$.

On the other hand, the processing to be performed when the change of the propagation time period is detected is as follows. First, a sonic velocity at the temperature k=40° C. is calculated by Expression (9) to be v=356 m/s. Then, a distance variation amount L is calculated by using Expression (11) to be L=3 mm. Then, by substituting the measured peak value Va in the sheet absent condition, the attenuation rate β of the output value with respect to the distance variation amount L, and the distance variation amount L for Expression (7), an output value Va' in the sheet absent condition affected only by the atmospheric pressure variation is obtained. Then, by using the output value Va' in the sheet absent condition affected only by the atmospheric pressure variation and the reference peak value $Va_0$, a circumstance correction coefficient α is calculated by Expression (8) to be α=0.857. Then, by using the calculated calculation coefficient τ and the calculated circumstance correction coefficient α, a calculation coefficient $\tau_r$ at the atmospheric pressure of 1 atm is calculated by Expression (3) to be $\tau_r$=0.033. When this result is collated with that shown in FIG. 4B, basis weight is correctly determined to be 100 g/m$^2$.

[Control Sequence]

Figure 8:
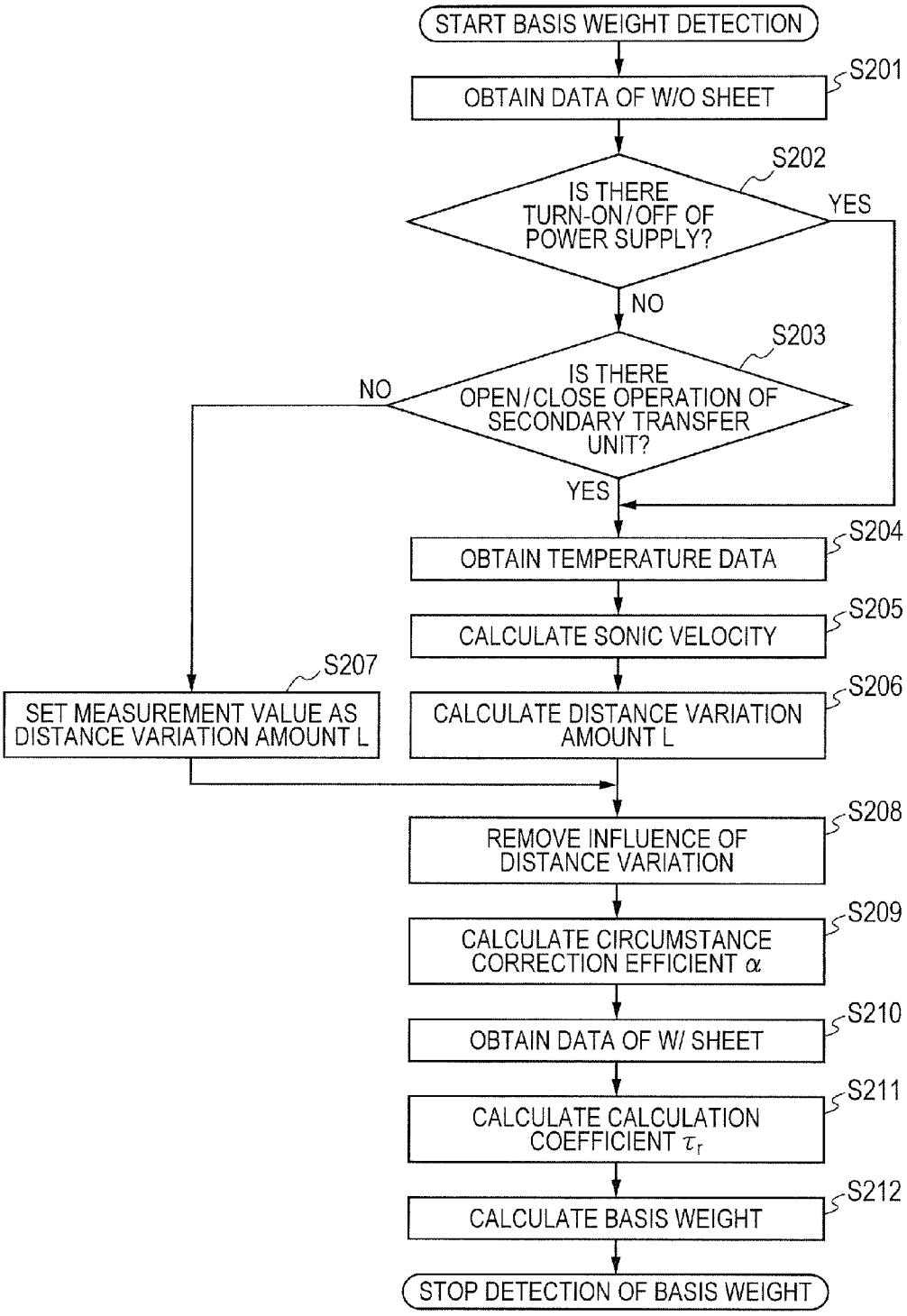
FIG. 8 is a flowchart illustrating a control sequence of basis weight detection according to the second embodiment.

Next, referring to FIG. 8, a method of determining the basis weight of the recording medium P according to this embodiment is described. FIG. 8 is a flowchart illustrating a control sequence of the control unit 60 of the basis weight detection sensor for determining the basis weight of the recording medium P. FIG. 8 illustrates the control sequence performed by the control unit 60 of the basis weight detection sensor. Parameters and a table necessary for basis weight calculation, for example, the distance d, the frequency f of the counter, the attenuation rate β, the peak value $Va_0$ in the sheet absent condition, the reference time $t_0$, and a table associating atmospheric pressure, a calculation coefficient, and basis weight, are stored in the storage unit 346 as in the case of the first embodiment.

The control unit 60 of the basis weight detection sensor controls the image forming apparatus 1 to start image formation and basis weight detection. In FIG. 8, the processing of Steps S201 to S203 is similar to that of Steps S101 to S103 of the first embodiment illustrated in FIG. 6, and thus description thereof is omitted. In Step S204, the control unit 60 obtains data on a temperature around the basis weight detection sensor from a temperature sensor (not shown). In Step S205, the control unit 60 calculates, based on the obtained temperature data, a sonic velocity v around the basis weight detection sensor (between transmission unit 31 and receiving unit 32) by Expression (9). In Step S206, the control unit 60 calculates a distance variation amount L by Expression (11). The processing of Steps S207 to S212 is similar to that of Steps S105 to S110 of the first embodiment illustrated in FIG. 6, and thus description thereof is omitted.

In the flowchart illustrated in FIG. 8, the control unit 60 of the basis weight detection sensor controls the basis weight detection processing. However, in place of the control unit 60, the CPU 80 of the image forming apparatus 1 may perform the control. The storage location of the parameters and the table of data measured in advance is not limited to the storage unit 346. For example, a ROM (not shown) included in the control unit 60 or a storage unit (not shown) included in the CPU 80 may be used. Further, according to this embodiment, the control unit 60 obtains the temperature data from the temperature sensor (not shown). However, for example, the temperature data may be obtained from the CPU 80.

Thus, according to this embodiment, even when the temperature around the sensor, the atmospheric pressure, and the sensor position simultaneously vary, a circumstance variation amount can be correctly obtained by calculating the velocity of the ultrasonic wave based on the information of the temperature sensor (not shown) and measuring the distance variation amount from the propagation time period of the ultrasonic wave. Therefore, the circumstance variation can be accurately corrected to improve basis weight detection accuracy. In the first and second embodiments, the peak extraction and the basis weight calculation are carried out by the different methods, specifically, by using the half-wave rectified reception signal waveform in the first embodiment and the voltage-doubler rectified reception signal waveform in the second embodiment. A combination of those signal processing and basis weight calculation methods can be arbitrarily selected. For example, by using the reception waveform processing method described above in the first embodiment, the circumstance correction considering the temperature change described above in the second embodiment may be carried out. As described above, according to this embodiment, a reduction in correction accuracy of circumstance variation caused by the positional deviation of the basis weight detection sensor can be prevented to improve determination accuracy of the basis weight of the recording medium.

Third Embodiment

In the data acquisition under the reference circumstance at the time of shipment and in the basis weight detection under the circumstance after the shipment in the first and second embodiments, equal voltage values are used for the pulse voltages of the driving signals input to the transmission unit 31. However, for the basis weight detection, it is not always necessary to input a pulse of a voltage value equal to that for the reference value acquisition to the transmission unit 31. In the following, a circumstance correction method when a pulse of a voltage value different from that for the reference value acquisition is input to the transmission unit 31 is described. Methods other than the circumstance correction method are similar to those of the first or second embodiment, and thus description thereof is omitted.

[Correction of Variation of Input Pulse Voltage of Driving Signal]

Now, a description is given on the circumstance correction method in a condition after the distance variation, which is described in the first or second embodiment, has been corrected. First, a reference peak value in the sheet absent condition obtained by an input pulse voltage $Vi_0$ under the reference circumstance is represented by $Va_0$. A peak value in the sheet absent condition obtained by an input pulse voltage $Vi_0$ under the circumstance of the basis weight detection is represented by $Va_1$. Under the circumstance of the basis weight detection, a sensor control unit 30 adjusts the input pulse voltage so that an obtained peak value Va can be equal to the reference peak value $Va_0$ in the sheet absent condition. As described above in the first embodiment, a piezoelectric element of the transmission unit 31 oscillates due to the input pulse voltage to generate an ultrasonic wave. Accordingly, an amplitude level of the ultrasonic wave is proportional to the input pulse voltage. Therefore, when the input pulse voltage adjusted so as to set $Va=Va_0$ is represented by $Vi_1$, a ratio of $Vi_0$ to $Vi_1$ is equal to that of $Va_1$ to $Va_0$ of Expression (2). Thus, by Expression (2), the following is established:

$$Vi_0/Vi_1 = Va_1/Va_0 = \alpha \quad (12)$$

A peak value Vp in the sheet present condition is measured by the adjusted input pulse voltage $Vi_1$, and a calculation coefficient τ is calculated by Expression (1). Then, from Expressions (3) and (12), a calculation coefficient $\tau_r$ after the circumstance correction can be calculated by Expression (13):

$$\tau_r = \tau/(Vi_0/Vi_1) \quad (13)$$

Thus, according to this embodiment, the pulse voltage input to the transmission unit 31 is adjusted so that the peak value Va in the sheet absent condition obtained under the circumstance of the basis weight detection can be equal to the reference peak value $Va_0$ in the sheet absent condition. Therefore, even in the case of an input pulse voltage different from that for the reference value measurement, circumstance correction can be carried out. As described above, according to this embodiment, a reduction in correction accuracy of circumstance variation caused by positional deviation of the basis weight detection sensor can be prevented to improve determination accuracy of the basis weight of the recording medium.

According to the above-mentioned embodiment, the basis weight detection sensor is fixed to the image forming apparatus 1. However, the basis weight detection sensor may be detachably mounted to the image forming apparatus 1. In the case of the configuration in which the basis weight detection sensor is detachably mounted, for example, when the basis weight detection sensor fails, the user can easily replace the sensor.

In the above-mentioned embodiment, the basis weight detection sensor and the control unit such as the basis weight detection sensor control unit 30 or the CPU 80 may be integrated to be detachably mounted to the image forming apparatus 1. If the basis weight detection sensor and the control unit are integrated to be replaceable as described above, when the functions of the basis weight detection sensor are to be updated or added, the user can easily replace the sensor by a sensor having new functions.

The embodiment has been described by way of example of a laser beam printer. However, the image forming apparatus to which the present invention is applied is not limited to this printer. A printer or a copying machine of another printing type such as an ink-jet printer may be used.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2014-091678, filed Apr. 25, 2014, which is hereby incorporated by reference herein in its entirety.

What is claimed is:

1. A recording medium determination apparatus, comprising:

a transmission unit configured to transmit an ultrasonic wave;

a receiving unit configured to receive an ultrasonic wave transmitted from the transmission unit via a recording medium and output a first signal according to the received ultrasonic wave, and receive an ultrasonic wave transmitted from the transmission unit not via the recording medium and output a second signal according to the received ultrasonic wave;

a detection unit configured to detect a value of the first signal and a value of the second signal output from the receiving unit;

a control unit configured to determine basis weight of the recording medium based on the value of the first signal detected by the detection unit;

a measurement unit configured to measure a period of time from when the transmission unit transmits the ultrasonic wave to when the detection unit detects the value of the second signal; and a moving unit configured to move between an opening position in which an inside of the recording medium determination apparatus is opened and a closing position in which the inside of the recording medium determination apparatus is closed, wherein the transmission unit or the receiving unit moves according to movement of the moving unit, wherein the control unit is configured to calculate, based on a reference period of time in a first condition in which the moving unit is at the closing position and a period of time measured by the measurement unit in a second condition in which the moving unit moves from the closing position to the opening position and from the opening position to the closing position at least one time after the first condition, a variation of a distance between the transmission unit and the receiving unit from the first condition to the second condition, to thereby determine the basis weight of the recording medium in accordance with the calculated variation of the distance and the value of the first signal.

2. A recording medium determination apparatus according to claim 1, wherein the control unit calculates the variation of the distance by multiplying a sonic velocity by a difference between the reference period of time in the first condition and the period of time measured by the measurement unit in the second condition.

3. A recording medium determination apparatus according to claim 2, further comprising a temperature detection unit configured to detect a temperature, wherein the control unit calculates the variation of the distance by using a sonic velocity calculated based on the temperature detected by the temperature detection unit.

4. A recording medium determination apparatus according to claim 3, wherein the temperature detection unit is arranged near the receiving unit.

5. A recording medium determination apparatus according to claim 1, further comprising a storage unit configured to store the reference period of time in the first condition.

6. A recording medium determination apparatus according to claim 1, wherein the detection unit detects a maximum value of the first signal and a maximum value of the second signal output from the receiving unit within a predetermined time period after the transmission unit transmits the ultrasonic wave.

7. A recording medium determination apparatus according to claim 1, wherein the control unit corrects, based on the calculated variation of the distance, the value of the second signal detected by the detection unit in the second condition, and calculates, based on the value of the second signal detected by the detection unit in the first condition and the corrected value of the second signal in the second condition, variation of atmospheric pressure between the transmission unit and the receiving unit from the first condition to the second condition, to thereby determine the basis weight of the recording medium in accordance with the calculated variation of the atmospheric pressure and the value of the first signal.

8. A recording medium determination apparatus according to claim 1, wherein the control unit determines the basis weight of the recording medium by using a calculation coefficient calculated based on a peak value of the first signal detected by the detection unit and a peak value of the second signal detected by the detection unit.

9. A recording medium determination apparatus according to claim 8, further comprising a table for associating the basis weight with the calculation coefficient, wherein the control unit determines the basis weight of the recording medium by reading basis weight corresponding to the calculation coefficient from the table.

10. A recording medium determination apparatus according to claim 1, wherein the detection unit detects a peak value of a signal obtained by subjecting each of the first signal and the second signal output from the receiving unit to half-wave rectification.

11. A recording medium determination apparatus according to claim 1, wherein the detection unit detects a peak value of a signal obtained by subjecting each of the first signal and the second signal output from the receiving unit to voltage doubler rectification.

12. A recording medium determination apparatus according to claim 1, further comprising a generation unit configured to generate a driving signal for controlling the transmission unit to transmit the ultrasonic wave, wherein the transmission unit transmits the ultrasonic wave having amplitude corresponding to a pulse voltage of the driving signal generated by the generation unit.

13. A recording medium determination apparatus according to claim 12, wherein a pulse voltage of the driving signal when the detection unit detects a peak value in the first condition and a pulse voltage of the driving signal when the detection unit detects a peak value in the second condition have the same voltage value.

14. A recording medium determination apparatus according to claim 12, wherein a pulse voltage of the driving signal when the detection unit detects a peak value in the first condition and a pulse voltage of the driving signal when the detection unit detects a peak value in the second condition have different voltage values.

15. A recording medium determination apparatus according to claim 1, wherein either the transmission unit or the receiving unit is attached to the moving unit.

16. A recording medium determination apparatus according to claim 1, wherein the moving unit moves between the opening position in which a conveyance path on which the recording medium is conveyed is opened and the closing position in which the conveyance path is closed.

17. An image forming apparatus, comprising:

an image forming unit configured to form an image on a recording medium;

a transmission unit configured to transmit an ultrasonic wave;

a receiving unit configured to receive an ultrasonic wave transmitted from the transmission unit via the recording medium and output a first signal corresponding to the received ultrasonic wave, and to receive an ultrasonic wave transmitted from the transmission unit not via the recording medium and output a second signal corresponding to the received ultrasonic wave;

a detection unit configured to detect a value of the first signal and a value of the second signal output from the receiving unit;

a control unit configured to control an image forming condition of the image forming unit based on the value of the first signal detected by the detection unit;

a measurement unit configured to measure a period of time from when the transmission unit transmits the ultrasonic wave to when the detection unit detects the value of the second signal; and a moving unit configured to move between an opening position in which an inside of the image forming apparatus is opened and a closing position in which the inside of the image forming apparatus is closed, wherein the transmission unit or the receiving unit moves according to movement of the moving unit, wherein the control unit is configured to calculate, based on a reference period of time in a first condition in which the moving unit is at the closing position and a period of time measured by the measurement unit in a second condition that is in which the moving unit moves from the closing position to the opening position and from the opening position to the closing position at least one time after the first condition, a variation of a distance between the transmission unit and the receiving unit from the first condition to the second condition, to thereby control the image forming condition of the image forming unit in accordance with the calculated variation of the distance and the value of the first signal.

18. An image forming apparatus according to claim 17, further comprising a conveyance path on which the recording medium is conveyed, wherein the image forming unit comprises an image forming portion configured to form a toner image on an image bearing member, and a transfer portion configured to transfer the toner image onto the recording medium; and wherein the transmission unit and the receiving unit are arranged oppositely to each other across the conveyance path, the transmission unit and the receiving unit being arranged on the conveyance path upstream of the transfer portion in a conveyance direction of the recording medium.

19. An image forming apparatus according to claim 18, wherein the transfer portion and either the transmission unit or the receiving unit are attached to the moving unit.

20. An image forming apparatus according to claim 18, wherein the moving unit moves the opening position in which the conveyance path is opened and the closed position in which the conveyance path is closed.

21. An image forming apparatus according to claim 17, further comprising a storage unit configured to store the reference period of time measured by the measurement unit in the first condition.

* * * * *